United States Patent [19]

Calvert

[11] Patent Number: 4,742,923

[45] Date of Patent: May 10, 1988

[54] GRAVITY FED DISPLAY AND DISPENSING APPARATUS

[75] Inventor: Peter W. Calvert, Johnson City, Tenn.

[73] Assignee: Thomas Industries, Inc., Johnson City, Tenn.

[21] Appl. No.: 40,189

[22] Filed: Apr. 20, 1987

[51] Int. Cl.[4] ..... A47F 7/00

[52] U.S. Cl. ..... 211/59.1; 211/66; 248/220.4

[58] Field of Search ..... 211/57.1, 59.1, 54.1, 211/181, 65, 66; 248/220.3, 221.1, 220.4; 206/362, 15.3

[56] References Cited

U.S. PATENT DOCUMENTS

| | | | |
|---|---|---|---|
| 2,051,408 | 8/1936 | Karst | 211/65 |
| 2,996,192 | 8/1961 | Dell et al. | 248/221.1 X |
| 3,070,339 | 12/1962 | Schoyer | 248/220.4 |
| 3,245,547 | 4/1966 | Felkay | 211/66 X |
| 3,374,898 | 3/1968 | Karmin | 248/221.1 |
| 3,452,954 | 7/1969 | Lucietto et al. | 211/59.1 X |
| 4,060,215 | 11/1977 | Burns et al. | 248/220.4 X |
| 4,064,991 | 12/1977 | Swanson | 211/65 X |
| 4,289,242 | 9/1981 | Kenyon | 211/59.1 X |
| 4,627,125 | 12/1986 | Gruns | 211/66 X |

*Primary Examiner*—Ramon S. Britts
*Assistant Examiner*—Sarah A. Lechok Eley

[57] ABSTRACT

An apparatus for suspending articles from a surface is disclosed having a head portion and three arm members extending outwardly from one side of the head portion, arranged at an angle with respect to the head portion and having a triangular configuration.

An article to be suspended is hung from the first arm member and extends between the second and third arm members which restrict the articles transverse movement. Both the first and third arm members are bent near their distal ends to restrict the articles movement in a longitudinal direction with respect to the arm members. The first arm member is also provided with an extension beyond the second and third arm members to allow for easy replacement of an article.

21 Claims, 1 Drawing Sheet

FIG.1
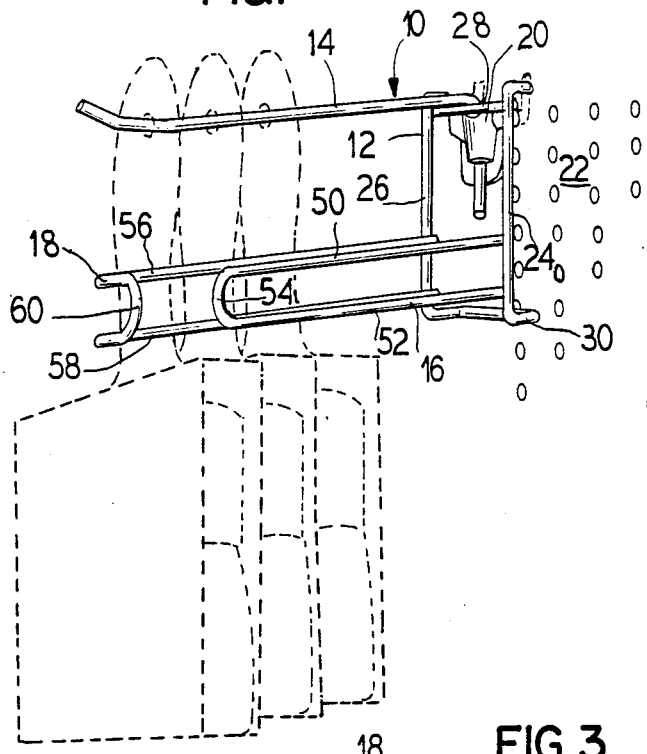
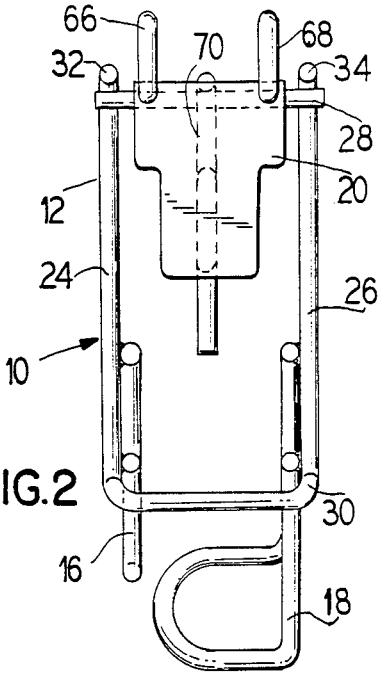
FIG.2
FIG. 3
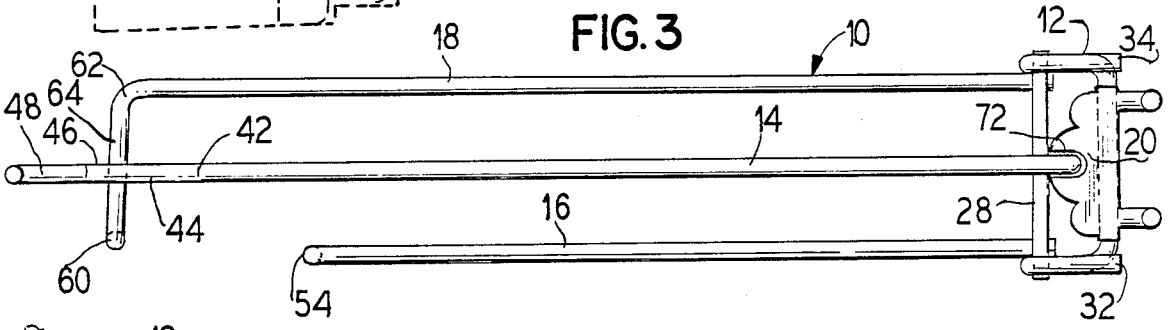
FIG. 4
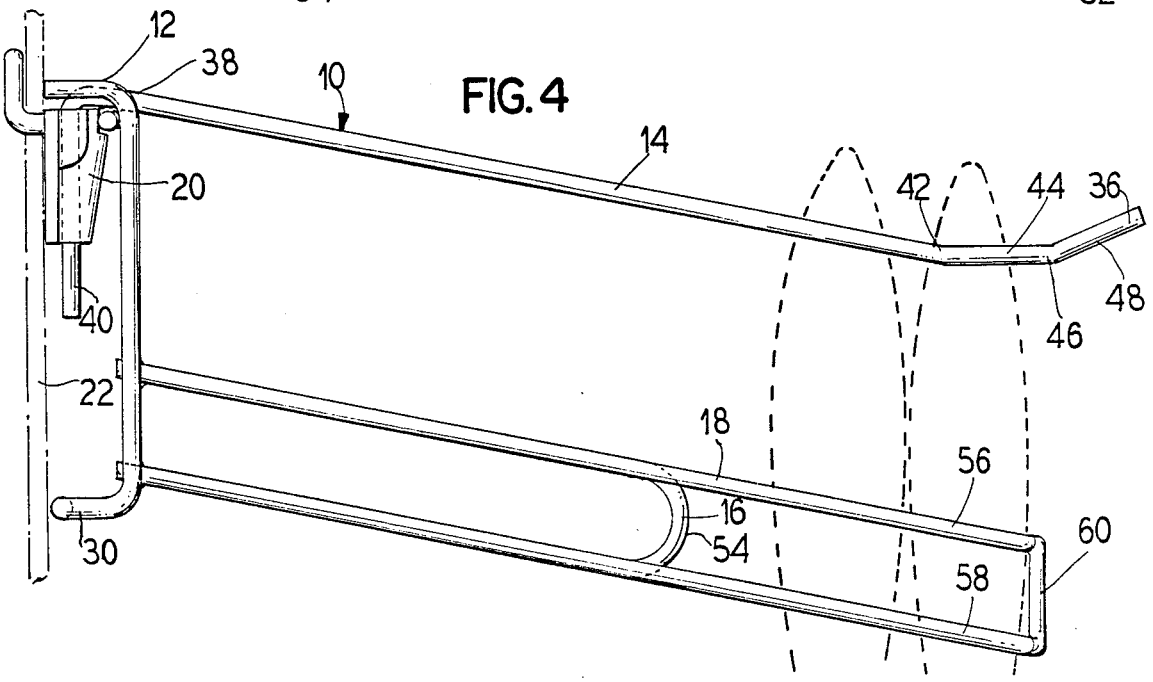

GRAVITY FED DISPLAY AND DISPENSING APPARATUS

BACKGROUND OF THE INVENTION

The present invention relates to a display apparatus and more particularly to a simple display and dispensing apparatus for articles which affixes to a pegboard, is gravity fed and provides for an easy, convenient replacement of the article by a customer after removal.

Display apparatus for pegboards are well known and are normally composed of a straight section of wire formed into a hook which is held within a desired hole of a pegboard. Articles to be displayed on such hooks normally have an aperture extending through the article which accepts the hook to create a hanging type display. Articles having handles are well suited for such a display, for example, paint brushes, having an aperture near one end of the handle.

Displays having just one wire extending from a pegboard are undesirable since they fail to keep the articles in a neat and tidy arrangement. When displaying paint brushes on these displays, for example, the brushes do not line up straight with respect to the adjacent rows of brushes and do not always line up one behind the other. Such a neat and tidy arrangement is highly desirable for displays located at the point of purchase in order to provide an ordered aesthetic appearance to the consumer who can more easily decide between type, size, quality and brands of paint brushes.

Attempts to provide an apparatus which solves the above mentioned problems have not been successful. One way of preventing movement between successive rows of brushes has been to arrange three straight lengths of wire in a triangular formation for each row of brushes. With this arrangement, the brush is suspended from the top wire while the other two wires surround the handle or bristle portion of the brush to prevent side to side misalignment. To provide a display where brushes line up one behind the other, displays have been designed where a shelf is suspended from a pegboard with a rearward angle as viewed by the consumer with the brushes arranged on the shelf using the triangular type hanger arrangement described above. With this arrangement, the brushes are gravity fed away from the consumer. The additional costs of these hangers, however, along with the specially designed shelfs, the instability of the shelf and its inability to readily adapt to existing simple pegboard displays make this approach highly undersirable.

OBJECTIVES AND SUMMARY OF THE INVENTION

It is therefore an object of the present invention to provide a novel apparatus for hanging articles from a display It is a feature of the present invention to have three arm members extending from a central head member which is affixed directly to an upstanding display surface, prevents movement between adjacent rows of articles, keeps the articles lined up one behind the other and enables easy replacement of an article by the customer.

It is an advantage of the present invention that the apparatus can be adapted for use with a wide variety of articles, can readily be used with simple existing display structures, is gravity fed and is extremely cost effective.

Briefly, and in accordance with the foregoing object, the apparatus of the present invention is comprised of a head member and first, second and third parallel arm members which are affixed to and extend outwardly from the head member on one side at a slight downward angle with respect to the head member.

These first, second and third arm members are arranged in a triangular formation with the first arm member at the top of the triangle, the second arm member at the bottom right of the triangle, and the third arm member at the bottom left of the triangle when viewing the apparatus from the distal ends of the arm members. The first arm member supports the article itself while the second and third arm members restrict movement in a transverse direction.

Both the first and third arm members are bent near their distal ends to restrict movement of the articles in a longitudinal direction with respect to the arm members.

Furthermore, the first arm member has a second bend beyond the first bend which extends past both the second and third arm members to enable easy replacement of an article that has been removed.

The apparatus of the present invention also utilizes a couple which readily affixes the apparatus to a pegboard. This couple can be modified to accept various forms of the apparatus and allows the apparatus to be easily repositioned on the pegboard.

BRIEF DESCRIPTION OF THE DRAWINGS

Further features and advantages of the present invention are set forth with particularlity in the appended claims. The invention may best be understood by making reference to the following description, taken in conjunction with the accompanying drawings and the several figures of which like reference numerals identify identical elements and wherein:

FIG. 1 is a front perspective view of the apparatus of the present invention suspended from a pegboard and is loaded with paint brushes;

FIG. 2 is a rear view of the apparatus of the present invention;

FIG. 3 is a top view of the apparatus of the present invention; and

FIG. 4 is a left side view of the apparatus illustrated in FIG. 1, depicting the apparatus afixed to a pegboard and having paint brushes suspended from the apparatus.

DESCRIPTION OF THE PREFERRED EMBODIMENT

The principles of the present invention are incorporated in a display and dispensing apparatus generally indicated by numeral 10 in the drawings.

As FIGS. 1–3 illustrate, the apparatus 10 is composed of a head portion 12, a first arm member 14, a second arm member 16 and a third arm member 18. The apparatus 10 is illustrated throughout the drawings in conjunction with a couple 20 which affixes the apparatus 10 to a flat surface 22 such as a pegboard, for example.

In the preferred embodiment, head portion 12 is formed from a single piece of hardened steel rod which is bent to the desired configuration. It is to be noted, however, that head portion 12 may be constructed from a variety of materials and may have a variety of shapes, all of which will accomplish the same function.

As FIG. 2 illustrates, the head portion 12 is composed of two side members 24 and 26, a cross member 28 and a bottom spacing member 30. The bottom spacing member 30 as well as top spacing members 32 and 34 of respective side members 24 and 26 are slightly bent away from the rear of the head portion 12. This rearward bend permits the head portion 12 to stand away from the pegboard 22 in use, thereby providing a space for couple 20. Additionally, an overall support of the apparatus 10 is provided by top spacing members 32 and 34, and the entire length of bottom spacing member 30 which contact the pegboard 22 and provide stability. The cross member 28 provides horizontal stability between the side members 24 and 26 as well as a support for first arm member 14.

As illustrated in FIG. 4, first arm member 14 has a distal end 36 and a proximal end 38 which, in the preferred embodiment, is welded to the center of cross member 28. Furthermore, the proximal end 38 of first arm member 14 extends beyond cross member 28 and is bent downward with respect to the head portion 12 to form an engagement leg member 40. This engagement leg member 40 interfaces directly with the couple 20 and lies in the standoff space created by the bottom spacing member 30 and the top spacing members 32 and 34 of side members 24 and 26 respectively.

The first arm member 14 is affixed to the head portion 12 and may be arranged at a slight angle toward the bottom spacing member 30 of head portion 12 in the preferred embodiment. This slight angle provides a gravity feed for the paint brushes or similar articles which are suspended from first arm member 14. As the drawings illustrate, gravity forces the articles downward and away from head portion 12 and toward the consumer when in use. This design thereby aligns the articles one behind the other while advancing the next brush to the front of the apparatus 10 so that the display always has a full appearance thereby reducing the amount of in-store housekeeping.

To catch the articles and to provide an even alignment of articles, arm member 14 is upwardly bent at 42 its distal end 36 to provide a first bent section 44. Additionally, arm member 14 is bent upwardly again at 46 to provide a final bent section 48. When apparatus 10 is suspended from a pegboard 22 first bent portion 44 is approximately horizontal which helps provide a stop for the gravity feed feature of the first arm member 14 but is primarily used for returning an article to apparatus 10 should a customer decide not to purchase. Second bent portion 48 prevents an article from falling off the distal end 36 of first arm member 14. These two bent portions 44 and 48 function somewhat differently in the reverse operation, when an article is replaced back onto arm member 14, as will be described in greater detail hereinafter.

Second arm member 16 is affixed to side member 24 of head portion 12 and has a slight angle with respect to head portion 12 so that second arm member 16 is virtually parallel with first arm member 14. In the preferred embodiment, second arm member 16 is also welded to head portion 12 and is formed in the shape of a horseshoe. This horseshoe is comprised of top member 50 and bottom member 52 whose distal end 54 projects away from the front side of head portion 12 a predetermined distance. This predetermined distance is normally less than the distance which first bend 42 of first arm member 14 extends away from head portion 12 and may vary with the width of an article to be suspended. The length of second arm member 16 is also somewhat shorter than third arm member 18 to allow articles to easily be loaded onto the apparatus 10.

Third arm member 18 is similarly affixed to head portion 12 at approximately the same angle as first and second arm members 14 and 16 and may also be parallel to first and second arm members 14 and 16. Third arm member 18 is horseshoe shaped and has a top portion 56, a bottom portion 58 and a distal end 60. This distal end 60 extends away from head portion 12 to a horizontal distance which lies between the first and second bends 42 and 46 of first arm member 14 along first bent portion 44. Furthermore, the distal end 60 of third arm member 18 is bent at 62 to form a bent portion 64 which lies at a right angle with respect to the third arm member 18. This bent portion 64 cooperates with first bent portion 44 of first arm member 14 to act as a stop for preventing further longitudinal movement of the articles suspended on first arm member 14 as they are fed down member 14 by gravity.

Third arm member 18 is spaced from second arm member 16 to provide a channel which accepts the articles to be suspended. This channel width may vary to accommodate articles of different widths or may vary to accommodate the handle or bristle portion of a paint brush. Furthermore, the distance between the first arm member 14 and second and third arm members 16 and 18 may vary depending upon the article to be suspended or may vary to accommodate the handle or bristle portion of a paint brush. In any event, second arm member 16 and third arm member 18 do not necessarily have to be equally spaced from first arm member 14, but can be arranged in any formation and with any spacing which will achieve the desired results.

As illustrated in FIGS. 2, 3 and 4, couple 20 is comprised of two upstanding hook members 66 and 68 which are inserted into the holes of the pegboard for suspending the apparatus 10. Additionally, couple 20 has a central aperture 70 which extends through the couple 20. This aperture 70 is slightly beveled and has a channel 72 formed in its top surface. The aperture 70 and the channel 72 accept the engagement leg member 40 of first arm member 14 to affix the apparatus 10 to the pegboard 22. The channel 72 also prevents rotation of the engagement leg member 40 within the couple 20 and provides a set angle for the apparatus 10 with respect to the pegboard 22.

In operation, couple 20 is affixed to pegboard 22 by inserting hook members 66 and 68 into the desired holes of the pegboard 22. Next, the engagement leg member 40 of first arm member 14 is inserted within the aperture 70 of couple 20 until the proximal end 38 of first arm member 14 is seated within the channel 72. In this position, the top spacing members 32 and 34 of sides 24 and 26 respectively as well as the bottom spacing member 30 of head portion 12 should contact pegboard 22 to further prevent rotation of the apparatus 10 around the engagement leg member 40 of first arm member 14 and to provide additional vertical support to the apparatus 10 upon its engagement with pegboard 22.

As illustrated in FIG. 1, several articles to be displayed, such as paint brushes, are loaded onto the distal end 36 of first arm member 14, are advanced past second bent section 48, second bend 46, first bend section 44 and second bend 42 until the apparatus 10 is completely loaded or until a desired number of articles are placed on the first arm member 14. It is to be noted that when loading such articles onto first arm member 14 the articles must be shifted towards second arm member 16 so that they may first clear the bent portion 64 of third arm member 18 and are then back toward third arm member 18 in front of the distal end 54 of second arm member 16 so that the handles of the articles may now be suspended between the second and third arm members 16 and 18.

With this arrangement, when not in use the most forward article is suspended from first arm member 14 at first bend 42 near first bent section 44 and lies against the interior side of bent portion 64 of third arm member 18 with the remaining articles stacked neatly behind it. Furthermore, transverse displacement of the articles is prevented since their handles are within the channel formed between second arm member 16 and third arm member 18.

To remove an article from the apparatus 10, the leading article is rotated toward second arm member 16 which relieves it from the bent portion 64 of third arm member 18 so that it may be pulled off the first and second bent portions 44 and 48 of first arm member 14 and entirely off the apparatus 10. When the leading article is removed in this manner, it can readily be understood that gravity forces the remaining articles downward along first arm member 14 to once again maintain the desired stacked arrangement.

For replacement, normally by the consumer, the article is merely placed back onto the distal end 36 of first arm member 14 where it will then slide by gravity along second bent portion 48 slightly past second bend 46 and onto first bent portion 44 till it comes to rest against the exterior side of bent portion 64 of third arm member 18. This is advantageous since the consumer does not have to perform any further steps to reload the article back onto the apparatus 10 which would normally involve pushing the remaining articles back up the first arm member 14 and rotating the article to be replaced back around the bent portion 64 of distal end 60 of third arm member 18. Additionally, the first bent portion 44 of first arm member 14 allows the article to rest parallel to the articles remaining on the apparatus without the head of the article projecting outward. Also, second bent portion 48 prevents a returned article from falling off of the apparatus 10.

While a particular embodiment of the present invention has been shown and described, modifications may be made to the apparatus without departing from the teachings of the present invention. Accordingly, the scope of the invention is only to be limited as necessitated by the accompanying claims.

I claim:

1. An apparatus for suspending articles from a surface comprising:

a head portion having a front and rear side;

a first arm member having distal and proximal ends, said promixal end being affixed to said head portion on said front side of said head portion, said first arm member having at least one bend defining at least one bent portion near its distal end;

a second arm member having distal and proximal ends, said proximal end being affixed to said head portion on said front side of said head portion spaced a predetermined distance from said first arm member and extending away from said head portion to a point where its distal end is slightly less than the extension of said at least one bend of said first arm member from said head portion;

a third arm member having distal and proximal ends, said proximal end being affixed to said head portion on said front side of said head portion spaced a predetermined distance from said first and second arm members and extending away from said head portion to a point where its distal end is proximate to the extension of said at least one bend of said first arm member from said head portion, said third arm member having a bend near its distal end defining a bent portion which extends in a direction toward said second arm member perpendicular to the direction of said bent portion of said first arm member;

means for affixing said rear side of said head portion to said surface, whereby an article to be suspended hangs from said first arm member and extends between said second and third arm members which restrict the article's transverse movement while said bent portions of said first and third arm members restrict the article's movement in a longitudinal direction with respect to said arm members.

2. The apparatus of claim 1, wherein said first, second and third arm members are arranged in a triangular configuration.

3. The apparatus of claim 2, wherein said at least one bend of said first arm member extends in a direction opposite the interior of said triangle formed by said first, second and third arm members.

4. The apparatus of claim 2, wherein said first arm member has a second bend creating a second bent portion at its distal end beyond said first bent portion extending at an angle with respect to said first bent portion in a direction opposite the interior of said triangle formed by said first second and third arm members.

5. An apparatus for suspending articles from a flat surface comprising:

a head portion having front and rear sides and a top and bottom edge a first arm member having distal and a proximal ends, said proximal end being affixed to said head portion on said front side of said head portion near a top edge of said head portion, said first arm member being affixed at an angle with respect to said head portion, said angle being toward the bottom edge of said head portion, said first arm member having a first bend creating a first bent portion near its distal end extending toward the top edge of said head portion, said first arm member having a second bend creating a second bent portion at the distal end of said first arm member beyond said first bent portion extending at an angle to said first bent portion toward the top edge of said head portion;

a second arm member having distal and a proximal ends, said proximal end being affixed to said head portion on said front side of said head portion near a bottom edge of said head portion, said second arm member extending away from said head portion parallel to said first arm member to a point where said distal end of said second arm member is slightly less than the extension of said first bend of said first arm member from said head portion;

a third arm member having distal and a proximal ends, said proximal end being affixed to said head portion on said front side of said head portion, near a bottom edge of said head portion to form a triangular configuration with said first and second arm members, said third arm member extending away from said head portion parallel to said first and second arm members to a point where said distal end of said third arm member is beyond said distal end of said second arm member and is proximate to the extension of said first bend of said first arm member from said head portion, said third arm member having a bend near its distal end extending in a direction toward said second arm member perpendicular to the direction of said bent portion of said first arm member;

means for affixing said rear side of said head portion to said flat surface, whereby an article to be suspended hangs from said first arm member and extends between said second and third arm members which restrict the article's transverse movement while said bent portions of said first and said third arm members restrict the article's movement in a longitudinal direction with respect to said arm members.

6. The apparatus of claim 5, wherein said distal end of said third arm member lies between the extension of said first and second bends of said first arm member along the length of said first bent portion.

7. The apparatus of claim 5, wherein said head portion has a standoff means on its rear side for spacing the head portion from the flat surface.

8. The apparatus of claim 5, wherein said head portion has an engagement means on its rear side for engagement with said means for affixing.

9. The apparatus of claim 8, wherein said means for affixing is comprised of a couple which is affixed to the flat surface and engages said engagement means of said head portion.

10. A display apparatus for suspending articles from a pegboard surface comprising:

a head portion having front and rear sides, said rear side having standoff means for spacing and supporting said head portion from said pegboard surface and a leg member affixed near a top side of said rear side of said head portion extending toward a bottom edge of said rear side of said head portion a predetermined distance;

first, second and third parallel arm members having distal and proximal ends, said proximal ends beings affixed to said front side of said head portion in a triangular configuration at an angle with respect to said head portion, said first arm member being affixed near the top edge of said head portion, said first arm member having first and second bends near its distal end creating first and second bent sections which extend in a direction opposite from the interior of the triangle formed by said first, second and third arm members, said second arm member having a length slightly smaller than the distance between said first bend of said first arm member and said head portion, said third arm member extending from said head portion to a point where its distal end lies between the extension of said first and second bends of said first arm member along the length of said first bent section, said third arm member having a bend near its distal end extending in a direction towards said second arm member perpendicular to the bending direction of said first and second bends of said first arm member; and a couple, having two outwardly projecting legs for insertion into the apertures of the pegboard, said couple having a central beveled aperture through its center and a channel on its exterior beveled end perpendicular to said aperture, whereby said couple is affixed to the pegboard and said leg member of said head portion is inserted within said aperture and said channel of said couple and an article to be suspended hangs from said first arm member and extends between said second and third arm members to restrict its transverse movement while said bends of said first and third arm members restrict the article's movement in a longitudinal direction with respect to said arm members.

11. The apparatus of claim 10, wherein said second and third arm members are horseshoe shaped each having top and bottom members which are affixed to said head portion at their proximal ends and are rounded off at their distal ends.

12. The apparatus of claim 10, wherein said standoff means is comprised of first, second and third spacing members which extend away from said rear side of said head portion a predetermined distance, said first and second spacing members being located near a top edge of said head portion on opposite sides of said rear side of said head portion while said third spacing member is located near a bottom edge of said head portion and extends across the width of said rear side of said head portion whereby said first, second and third spacing members space said head member from said pegboard and provide support for said apparatus in both a horizontal and vertical direction.

13. The apparatus of claim 12, wherein said leg member of said head portion lies within the space created by said first, second and third spacing members between said pegboard and said rear side of said head portion.

14. The apparatus of claim 13, wherein said leg member of said head portion is formed from an extension of the proximal end of said first arm member.

15. An apparatus for suspending articles to be displayed, comprising first means for affixing said apparatus to a vertical surface, second means projecting from said first means away from said surface having a distal end, guide means projecting from said second means, said guide means including parallel wall defining members, one of which extends distally beyond a distal end of the other and terminates in an in-turned stop portion substantially normal to the plane of projection of said guide means from said first means, said second means including a projection member having a pair of spaced apart bends adjacent a distal end thereof, said projecting member projecting from said first means at an angle thereto such that when said apparatus is affixed to a vertical surface said projecting member extends downwardly and outwardly away from said surface with a portion of said projecting member between said bends being substantially horizontal and a portion of said projecting member from one of said bends to the distal end of said projecting member being angled upwardly from said horizontal.

16. An apparatus according to claim 15, wherein said wall defining members are positioned below said projecting member and project at an angle from said first means so as to be substantially parallel with a major portion of the projection of the projecting member.

17. An apparatus according to claim 16, wherein said in-turned stop is positioned at a distance from said first means to extend in a plane substantially vertically intersecting said horizontal portion of said projecting member.

18. A display device for displaying hangable articles comprising a first means adapted to be affixed to a display surface, first, second and third projecting members attached to said first means and projecting therefrom away from said surface, said first member being rod-like and terminating in a distal end, including first and second spaced-apart bends along the length of said first member, said first member being fixed at an angle to said first means such that when said first means is affixed to a surface, said first member extends outwardly and downwardly away from said surface terminating in a distal end projecting outwardly and upwardly, said second and third members being positioned below said first member in a substantially parallel relationship to one another, defining an article receiving slot below said first member between said second and third members, said second member having a distal end projecting beyond a distal end of said third member, said second member including an in-turned portion adjacent the distal end thereof which extends back towards said third member a distance sufficient to underlie said first member in an area of said first member between said first and second bends, whereby said in-turned portion acts as a stop member limiting downward movement of articles hung from said first member.

19. An apparatus for suspending articles to be displayed, comprising first means for affixing said apparatus to a surface, second means projecting from said first means away from said surface said second means having distal end, guide means projecting from said second means, said guide means including parallel wall defining members, one of which extends distally beyond a distal end of the other and terminates in an in-turned stop portion substantially normal to the plane of projection of said guide means from said first means, said second means including a projecting member having a pair of spaced apart bends adjacent a distal end thereof, said projecting member projecting from said first means at an angle thereto such that when said apparatus is affixed to a vertical surface said projecting member extends outwardly away from said surface with a portion of said projecting member between said bends being substantially horizontal and a portion of said second member from one of said bends to the distal end of said second member being angled upwardly from said horizontal.

20. An apparatus for displaying objects in association with a pegboard comprising a coupling member having a main body member including a pair of spaced apart projecting hook members adapted to be received through openings in the pegboard to suspend the main body member from a front surface of the pegboard, said main body member having a generally vertical bore therein from the top surface thereof, a channel formed in said main body member from a front surface thereof open to the top surface and communicating to the bore, a display member for supporting a series of articles to be displayed, said display member including attachment means for attaching said display member to said coupling member, said attachment means including a projecting member having a first section adapted to be received in said bore and a second section projecting at an angle from said first section adapted to be received in said channel whereby when said second section is received in said channel said first section is immobilized against rotation in said aperture, support means operatively connected to said attachment means and projecting therefrom for supporting articles to be displayed, guide means operatively connected to said attachment means and projecting therefrom, said guide means spaced below said support means and including a pair of generally parallel spaced apart wall defining members providing a channel therebetween adapted to receive portions of and to limit movement of members suspended from said support means and said display member being removable from said coupling member.

21. The apparatus of claim 20 wherein the display member is removable from the coupling member while the coupling member is suspended from the pegboard.

* * * * *